US007413321B2

(12) United States Patent
Kim

(10) Patent No.: US 7,413,321 B2
(45) Date of Patent: Aug. 19, 2008

(54) LIGHT-EMITTING DIODE SHELF

(75) Inventor: Steven Kim, Palisades Park, NJ (US)
(73) Assignee: LED Folio Corporation, Palisades Park, NJ (US)

( * ) Notice: Subject to any disclaimer, the term of this patent is extended or adjusted under 35 U.S.C. 154(b) by 0 days.
(21) Appl. No.: 11/797,580
(22) Filed: May 4, 2007
(65) Prior Publication Data
US 2007/0256340 A1 Nov. 8, 2007
Related U.S. Application Data
(60) Provisional application No. 60/797,676, filed on May 5, 2006.
(51) Int. Cl.
*F21V 8/00* (2006.01)
(52) U.S. Cl. ..... 362/127; 362/253; 362/602
(58) Field of Classification Search ..... 362/127, 362/133, 253, 92, 602, 604, 606, 623, 617, 362/618
See application file for complete search history.

(56) References Cited

U.S. PATENT DOCUMENTS

| | | | | |
|---|---|---|---|---|
| 5,461,547 | A * | 10/1995 | Ciupke et al. | 362/617 |
| 6,210,013 | B1 * | 4/2001 | Bousfield | 362/92 |
| 2004/0264160 | A1 * | 12/2004 | Bienick | 362/31 |
| 2004/0264161 | A1 * | 12/2004 | Wu | 362/31 |
| 2005/0185395 | A1 * | 8/2005 | Pinter | 362/201 |
| 2007/0127229 | A1 * | 6/2007 | Lee et al. | 362/92 |
| 2007/0230212 | A1 * | 10/2007 | Misof | 362/600 |
| 2007/0268709 | A1 * | 11/2007 | Oketani et al. | 362/378 |

* cited by examiner

*Primary Examiner*—Laura Tso
(74) *Attorney, Agent, or Firm*—Holland & Knight LLP

(57) ABSTRACT

A light-emitting diode shelf includes a light guide panel, a reflector covering a first side of the light guide panel, a first diffuser covering a second side of the light guide panel, a second diffuser covering the reflector, a light-emitting diode strip at an edge of the light guide panel, and a base encompassing the light-emitting diode strip and attached to the light guide panel.

20 Claims, 5 Drawing Sheets

LIGHT-EMITTING DIODE SHELF

This invention claims the benefit of U.S. Provisional Application No. 60/797,676 filed on May 5, 2006, which is hereby incorporated by reference in its entirety.

BACKGROUND OF THE INVENTION

1. Field of the Invention

Embodiments of the invention relate to lighting, and more particularly, to a light-emitting diode shelf. Although embodiments of the invention are suitable for a wide scope of applications, it is particularly suitable for the emission of low-intensity planar light from a shelf for display lighting.

2. Discussion of the Related Art

In general, display cases are used to display wares in a commercial setting and prized possessions in a residential settings. Display cases can be open or closed. Closed display cases can have transparent doors on the front of the case, or the front of the case can be transparent and the doors are either at the side or on the back of the case. Some display cases contain shelves on which items can be positioned for display and illuminated by a lighting fixture or lighting fixtures within the display case.

Lighting fixtures for display cases use point light sources, such as incandescent bulbs, or linear light sources, such as fluorescent light tubes. Point light sources are typically shaded or directed in such way so as not to be directly in the line of sight for an individual since the high intensity of point light sources can cause discomfort. Point light sources usually emit light at a relatively high-intensity so as to be able to provide a sufficient lighting. Linear light sources can be less intense but yet emit sufficient lighting because the light emits all along the length of the linear light source. Although not as intense, linear light sources are typically diffused or shielded in such way so as not to cause discomfort. The diffusers of most linear light sources are configured to emulate a planar light source by widely diffusing a source light into a lower intensity light across a plane.

Typically, lighting schemes for display cases are implemented by using fixtures mounted in one or two of three locations within the display case. The first location is at the top of the display case so to provide light for items on the top shelf or for items on all of the shelves if the shelves are transparent. The entire case is not sufficiently lit by lighting fixtures just at the top location of the display case and items at the sides of the display case can have unflattering shadows. The second location is at the front of the display case such that the light travels toward the items on the shelf in somewhat the same direction an individual would view the item. The lighting fixtures at the front location of the display case can generate glare off of the items on display. The third location is at the back of the display case adjacent to and under each of the shelves so as to provide light high above and from behind the items on each shelf. The lighting fixtures at the back location of the display case can generate unflattering shadows for the items on display.

Lighting fixtures for display cases should provide light to items on a shelf such that a light source or light sources will provide sufficient light to the entire display case such that areas of the display case are not too bright or not too dark. Further, the light sources should not cause any discomfort in the nominal viewing directions into the display case. Furthermore, the lighting fixtures for display cases should illuminate items without glare or shadows.

SUMMARY OF THE INVENTION

Accordingly, embodiments of the invention are directed to a light-emitting diode shelf that substantially obviates one or more of the problems due to limitations and disadvantages of the related art.

An object of embodiments of the invention is to provide comfortable lighting for a display case.

Another object of embodiments of the invention is to provide lighting for a display case that prevents glare.

Another object of embodiments of the invention is to provide lighting for a display case that prevents shadows.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a light-emitting diode shelf includes a light-emitting diode shelf includes a light guide panel, a reflector covering a first side of the light guide panel, a first diffuser covering a second side of the light guide panel, a second diffuser covering the reflector, a light-emitting diode strip at an edge of the light guide panel, and a base encompassing the light-emitting diode strip and attached to the light guide panel.

In another aspect, a light-emitting diode shelf includes a light guide panel, a reflector covering a first side of the light guide panel, a diffuser covering a second side of the light guide panel, a light-emitting diode strip at an edge of the light guide panel, and a base encompassing the light-emitting diode strip and attached to the light guide panel, wherein a portion of the reflector is on the second side of the light guide panel.

In yet another aspect, a light-emitting diode shelf includes a light guide panel, a reflector covering a first side of the light guide panel, a diffuser covering a second side of the light guide panel, a light-emitting diode strip at an edge of the light guide panel, and a base encompassing the light-emitting diode strip and attached to the light guide panel, wherein the light guide panel has an outside edge, opposite to the inside edge of the light guide panel, that is rounded.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings.

DETAILED DESCRIPTION OF THE PREFERRED EMBODIMENTS

Figure 1A:
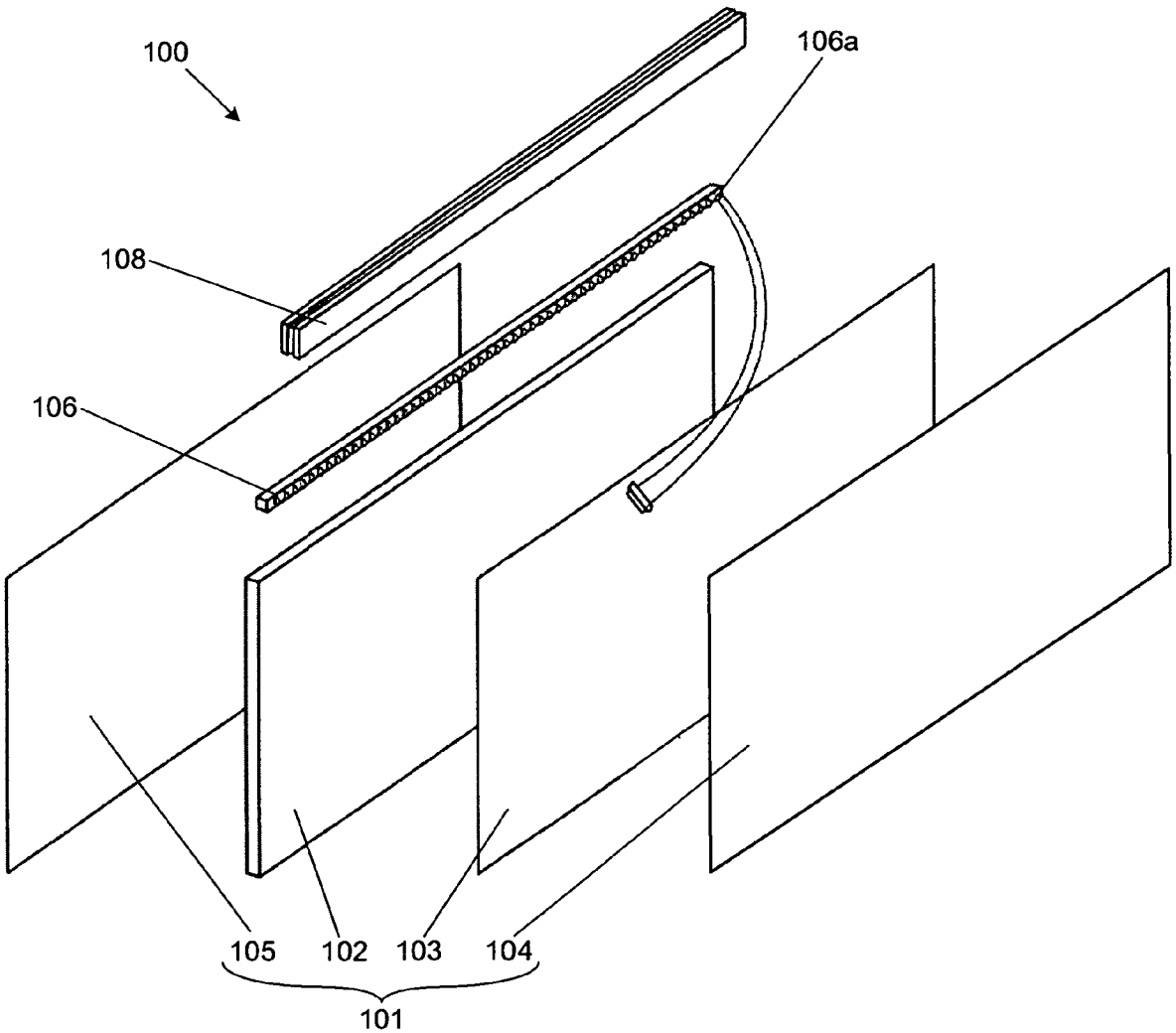
FIG. 1*a* is an exploded view of a light-emitting diode shelf according to an embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Figure 1B:
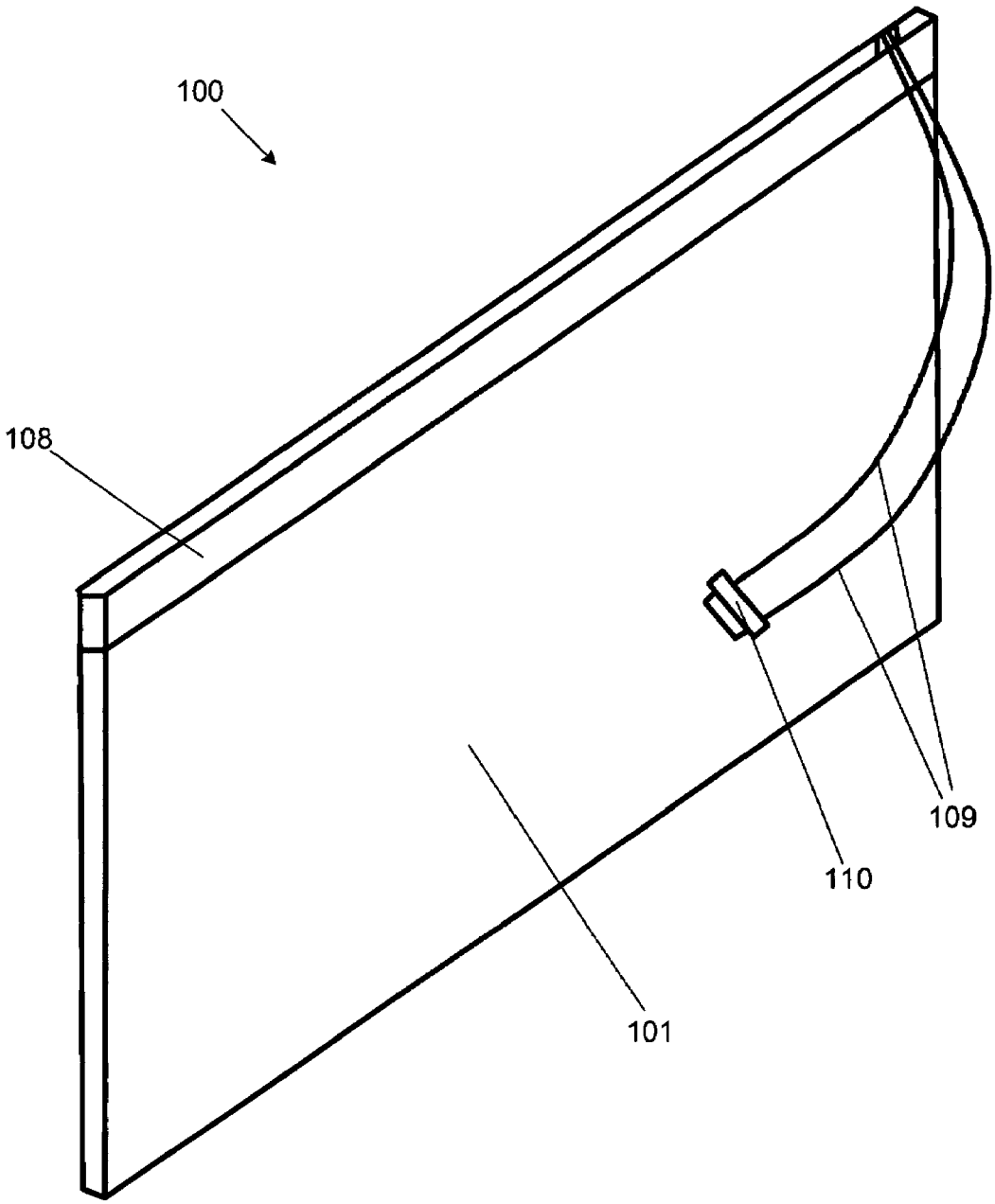
FIG. 1*b* is an assembled view of the light-emitting diode shelf shown in FIG. 1*a;*

FIG. 1*a* is an exploded view of a light-emitting diode shelf according to an embodiment of the invention. FIG. 1*b* is an assembled view of the light-emitting diode shelf shown in FIG. 1*a*. As shown in FIGS. 1*a* and 1*b*, a light-emitting diode shelf 100 includes a panel assembly 101, a light-emitting diode (LED) strip 106, and a base 108. The panel assembly 101 has a light guide panel 102, a top reflector 103, a top diffuser 104 and a bottom diffuser 105. The light guide panel 102 receives light from the LED strip 106 at a top edge 102*a* of the light guide panel 102 and disperses the light across the light guide panel 102 into lower intensity light that is then emitted from the light guide panel 102 through the bottom diffuser cover 105 and through the top diffuser 104 if the top reflector 103 is a partial mirror instead of a full mirror.

The bottom diffuser 105 covers a first side of the light guide panel 102 and diffuses light from the light guide panel 102. The top reflector 103 covers a second side of the light guide panel 102 and reflects light from the light guide panel 102 back through the light guide panel 102 toward the bottom diffuser 105. If the top reflector 103 partially mirrors instead of fully mirroring, some of the light from the light guide panel 102 transmits through the partially-mirrored top reflector 103 toward the top diffuser 104, which covers the top reflector 103. The top diffuser 104 diffuses light via the partially-mirrored top reflector 103 from the light guide panel 102. In an alternative embodiment, the top diffuser 104 can be omitted if the top reflector 103 is fully mirrored for complete reflection.

The LED strip 106 includes a plurality of light-emitting diodes 106*a* along the length of the LED strip 106. The light-emitting diodes 106*a* can be one of white light-emitting diodes, blue light-emitting diodes, ultraviolet light-emitting diodes, and a combination of red, green and blue light-emitting diodes. If the light-emitting diodes 106*a* are either blue light-emitting diodes or ultraviolet light-emitting diodes, the panel assembly 101 is configured to change the blue light or ultraviolet light into visible light. Examples of such configurations include a visible light conversion film between the LED strip 106 and the top edge 102*a* of the a light guide panel 102, visible light conversion films between the light guide panel 102 and the bottom diffuser 105 as well as between the light guide panel 102 and the top diffuser 104, and the light guide panel 102 itself can have a visible light conversion capability. Power is provided to the LED strip 106 through wires 109 attached to a connector 110.

The base 108 receives the LED strip 106 within the base 108 such that internal surfaces of the base 108 act as a reflector that reflects light from the light-emitting diodes 105*a* toward the top edge 102*a* of the light guide panel 102. Further, the base 108 receives the top edge 102*a* of the light guide panel 102. As shown in FIG. 1*b*, the base 108 of the a light-emitting diode shelf 100 encompasses the LED strip 106 and also retains the light guide panel 102 in place with respect to the LED strip 106. The base 108 is made of a heat conductive material, such as a metal, to conduct heat generated by the light-emitting diodes 106*a* away from the light-emitting diodes 106*a*.

Figure 2:
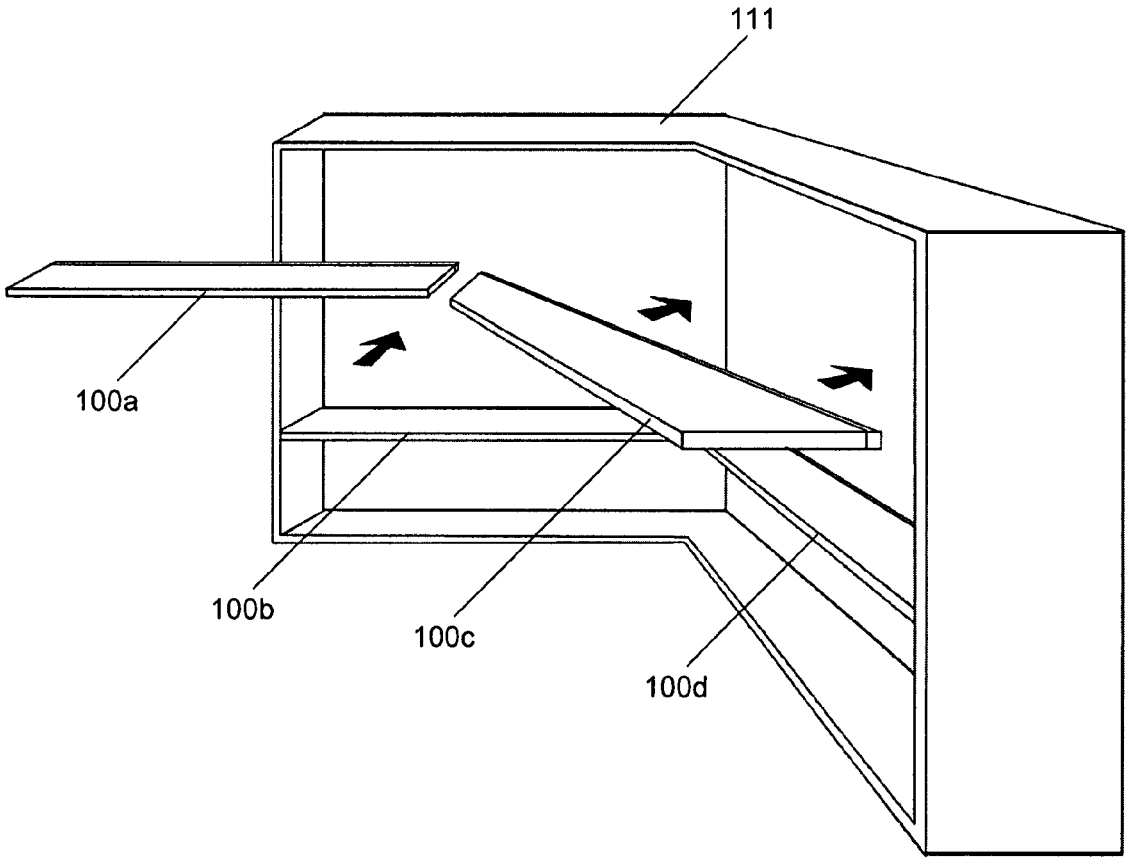
FIG. 2 is a perspective view of the light-emitting diode shelf shown in FIG. 1*b* in an open display case.

FIG. 2 is a perspective view of the light-emitting diode shelf shown in FIG. 1*b* in an open display case. As shown in FIG. 2, the open display case 111 can receive light-emitting diode shelves 100*a*, 100*b*, 100*c* and 100*d* as shelving. Light-emitting diode shelves 100*a* and 100*c*, or 100*b* and 100*d* can be mitered at the corner of an open display case 111, as shown in FIG. 2. Each of the light-emitting diode shelves 100*a*, 100*b*, 100*c* and 100*d* emits downward planar light with a first intensity and an upward planar light having a second intensity, which is less than the first intensity. In the alternative, each of the light-emitting diode shelves 100*a*, 100*b*, 100*c* and 100*d* only emits downward planar light, when the reflector of the light-emitting diode shelves 100*a*, 100*b*, 100*c* and 100*d* are fully mirrored for complete reflection. In yet another alternative, a light-emitting diode shelf that only emits downward planar light can be used with another light-emitting diode shelf that emits both downward planar light and upward planar light.

The downward planar light fully illuminates items on surfaces under each of the light-emitting diode shelves without glare and reduces shadows from the items. The upward planar light illuminates items on the light-emitting diode shelf without glare and prevents shadows from the items. Accordingly, items illuminated by either the upward planar light or downward planar light can be comfortably viewed without shadows at the sides of the items. Further, items on one light-emitting diode shelf having upward planar light emission and under another light-emitting diode shelf having downward planar light emission are fully illuminated in all viewing directions and can be comfortably viewed without shadows.

Figure 3:
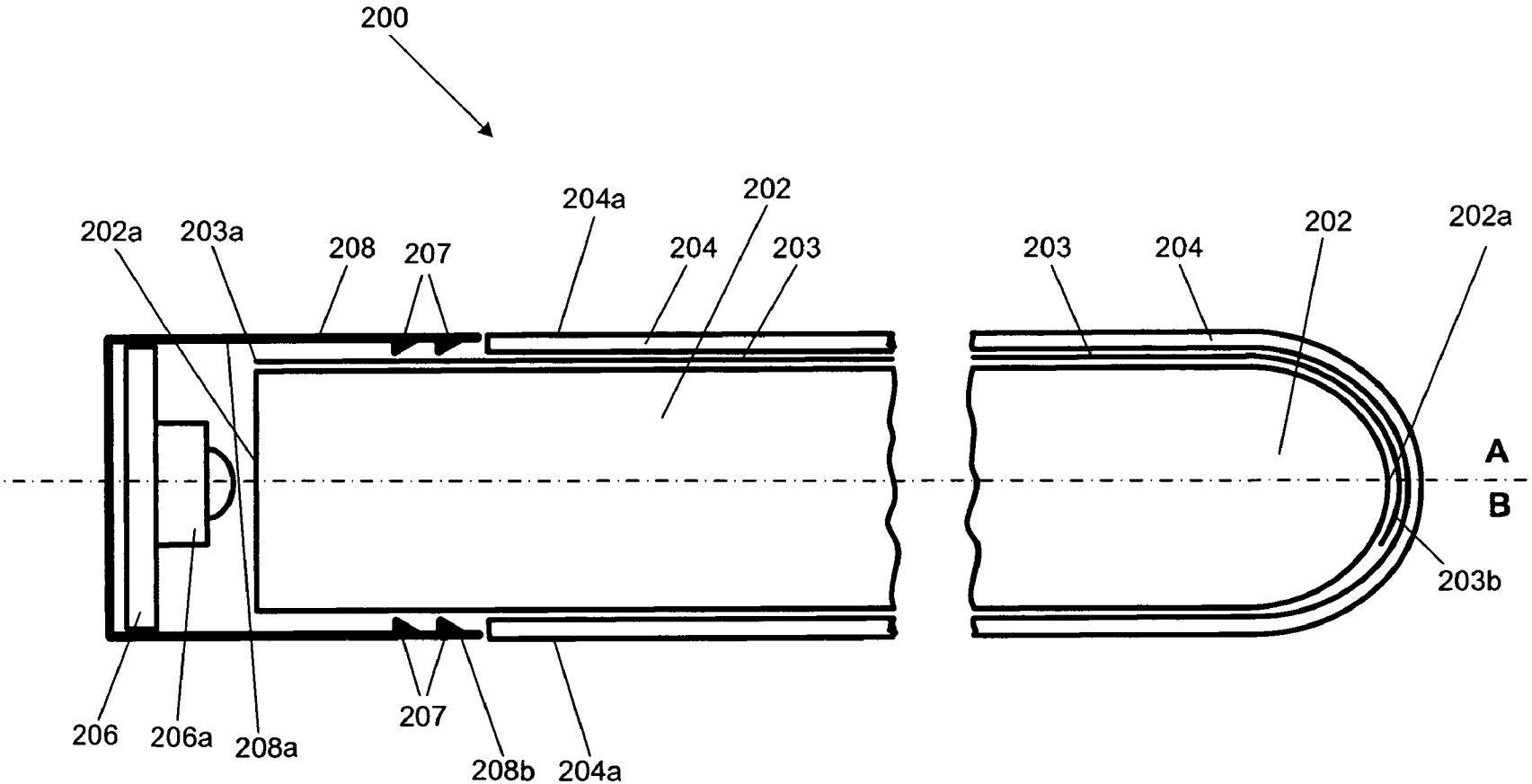
FIG. 3 is a cross-sectional view of a light-emitting diode shelf in embodiment of the invention having a wrap-around diffuser.

FIG. 3 is a cross-sectional view of a light-emitting diode shelf in an embodiment of the invention having a wrap-around diffuser. As shown in FIG. 3, a light-emitting diode shelf 200 has a light guide panel 202 with an inside edge 202*a* in the base 208 and an outside edge 202*b*, opposite to the inside edge 202*a*, that is rounded. The reflector 203 is on a first side A of the light guide panel 203 and a portion 203*b* of the reflector 203 is on a second side B of the light guide panel 202 by going along the rounded outside edge 202 of the light guide panel 202. The diffuser 204 is on the reflector 203 along the first side A of the light guide panel 203 and on the light guide panel 202 along the second side B of the light guide panel 203 by wrapping around the outside edge 202*b* of the light guide panel.

The base 208 receives the inside edge 202*a* of the light guide panel 202 and the inside edge 203*a* of the reflector 203. Although an adhesive (not shown) can be used to attach the light guide panel 202 to the base 208, protrusions 207 on the internal surfaces 208*a* of the base 208 are used to assist in retaining the light guide panel 202 and the reflector 203 within the base 208. Similarly, the base 108 of FIG. 1 can have such protrusions to retain the light guide panel 102 and the reflector 103 within the base 108.

Outside surfaces 204*a* of the diffuser 204 can be substantially coplanar with the external surfaces 208*b* of the base 208. More specifically, a step difference between the external surfaces 208*b* of the base 208 and the outside surfaces 204*a* of the diffuser 204 or the lack of a step difference between the external surfaces 208*b* of the base 208 and the outside surfaces 204*a* of the diffuser 204 allows items to be slid onto the light-emitting diode shelf 200 across the base 208. Further, the diffuser 204 can abut the base 208 so as to create a seal to the base 208.

Figure 4:
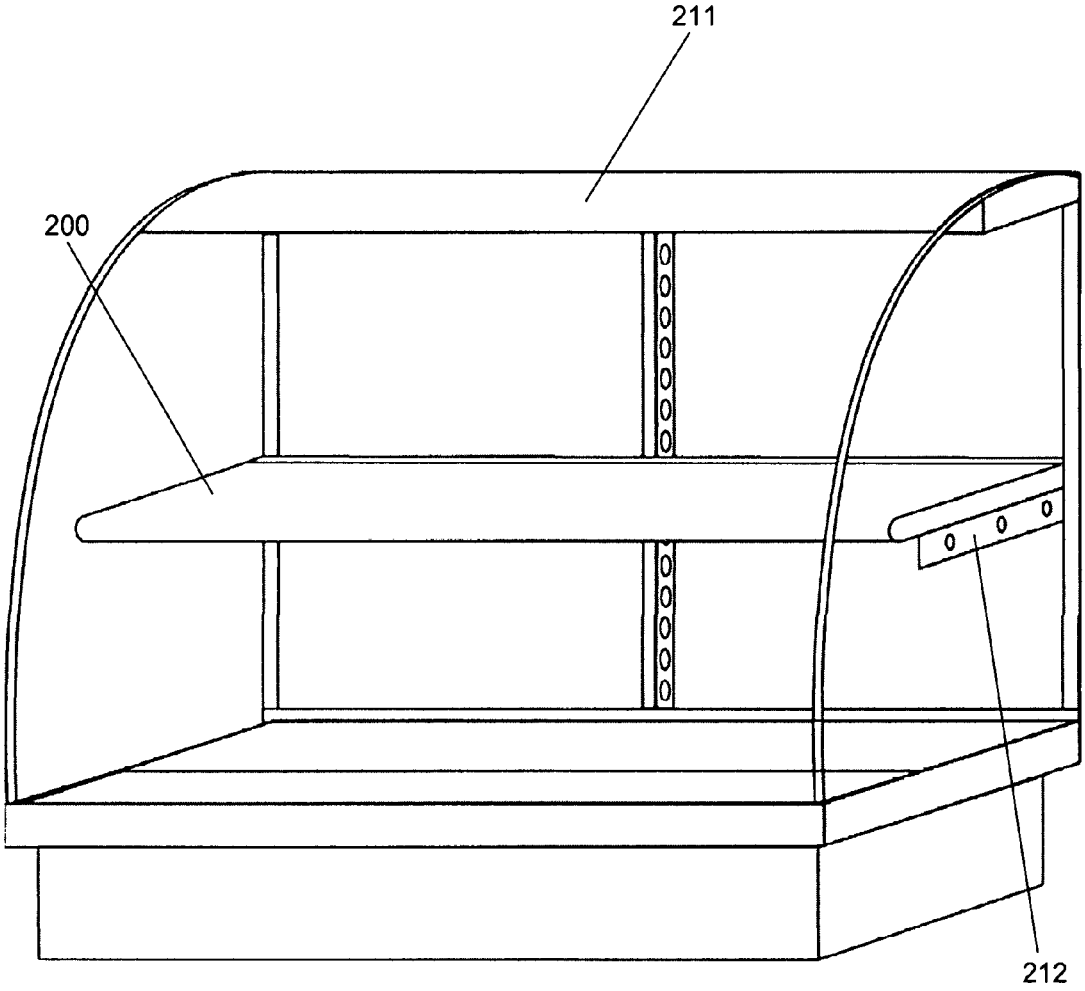
FIG. 4 is a perspective view of the light-emitting diode shelf shown in FIG. 3 within a closed display case.

FIG. 4 is a perspective view of the light-emitting diode shelf shown in FIG. 3 within a closed display case. As shown in FIG. 4, the closed display case 211 can receive a light-emitting diode shelf 200 on a bracket 212. The light-emitting diode shelf 200 emits downward planar light as well as light toward the front of the closed display case 211 with a first intensity and an upward planar light having a second intensity, which is less than the first intensity. In the alternative, the light-emitting diode shelf 200 only emits the downward planar light and the light toward the front of the closed display case 211, when the reflector of the light-emitting diode shelf 200 is a full mirrored for complete reflection.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A light-emitting diode shelf, comprising:

a light guide panel;

a reflector covering a first side of the light guide panel;

a first diffuser covering a second side of the light guide panel;

a second diffuser covering the reflector;

a light-emitting diode strip at an edge of the light guide panel; and a base encompassing the light-emitting diode strip and attached to the light guide panel, wherein the light-emitting diode shelf is mounted horizontally in a support.

2. The light-emitting diode shelf of claim 1, wherein the base internal surfaces reflecting light from the light-emitting diode strip toward the light guide panel.

3. The light-emitting diode shelf of claim 1, wherein the reflector includes a partial mirror.

4. The light-emitting diode shelf of claim 1, wherein the reflector and the light guide panel have inside edges within the base.

5. The light-emitting diode shelf of claim 4, further comprising protrusions on internal surfaces of the base for retaining the light guide panel and the reflector within the base.

6. A light-emitting diode shelf, comprising:

a light guide panel;

a reflector covering a first side of the light guide panel;

a diffuser covering a second side of the light guide panel;

a light-emitting diode strip at an edge of the light guide panel; and a base encompassing the light-emitting diode strip and attached to the light guide panel, wherein a portion of the reflector is on the second side of the light guide panel and the light-emitting diode shelf is mounted horizontally in a support.

7. The light-emitting diode shelf of claim 6, wherein the base has internal surfaces reflecting light from the light-emitting diode strip toward the light guide panel.

8. The light-emitting diode shelf of claim 6, wherein the reflector includes a partial mirror.

9. The light-emitting diode shelf of claim 6, wherein the reflector and the light guide panel have inside edges within the base.

10. The light-emitting diode shelf of claim 9, further comprising protrusions on internal surfaces of the base for retaining the light guide panel and the reflector within the base.

11. The light-emitting diode shelf of claim 9, wherein the light guide panel has an outside edge, opposite to the inside edge of the light guide panel, that is rounded.

12. The light-emitting diode shelf of claim 6, wherein the diffuser covers the reflector on the second side of the light guide panel.

13. The light-emitting diode shelf of claim 12, wherein the diffuser has outside surfaces substantially coplanar with external surfaces of the base.

14. A light-emitting diode shelf, comprising:

a light guide panel;

a reflector covering a first side of the light guide panel;

a diffuser covering a second side of the light guide panel;

a light-emitting diode strip at an edge of the light guide panel; and a base encompassing the light-emitting diode strip and attached to the light guide panel, wherein the light-emitting diode shelf is mounted horizontally in a support and the light guide panel has an outside edge, opposite to an inside edge of the light guide panel, that is rounded.

15. The light-emitting diode shelf of claim 14, wherein the base has internal surfaces of reflecting light from the light-emitting diode strip toward the light guide panel.

16. The light-emitting diode shelf of claim 14, wherein the reflector includes a partial mirror.

17. The light-emitting diode shelf of claim 14, wherein the reflector and the light guide panel have inside edges within the base.

18. The light-emitting diode shelf of claim 17, further comprising protrusions on internal surfaces of the base for retaining the light guide panel and the reflector within the base.

19. The light-emitting diode shelf of claim 14, wherein the diffuser covers the reflector on the second side of the light guide panel.

20. The light-emitting diode shelf of claim 19, wherein the diffuser has outside surfaces substantially coplanar with external surfaces of the base.

* * * * *